US005217859A

United States Patent [19]

Boettcher et al.

[11] Patent Number: 5,217,859

[45] Date of Patent: Jun. 8, 1993

[54] AQUEOUS, SOLID PARTICLE DISPERSIONS OF DICHALCOGENIDES FOR PHOTOGRAPHIC EMULSIONS AND COATINGS

[75] Inventors: John W. Boettcher, Webster; Roger L. Klaus; Joseph W. Manthey, both of Rochester, all of N.Y.

[73] Assignee: Eastman Kodak Company, Rochester, N.Y.

[21] Appl. No.: 869,678

[22] Filed: Apr. 16, 1992

[51] Int. Cl.[5] ..... G03C 1/34

[52] U.S. Cl. ..... 430/569; 430/607; 430/608; 430/611

[58] Field of Search ..... 430/611, 607, 608, 546, 430/567, 569

[56] References Cited

U.S. PATENT DOCUMENTS

| | | | |
|---|---|---|---|
| 1,962,133 | 6/1934 | Brooker et al. | 430/611 |
| 2,465,149 | 3/1949 | Dersch et al. | |
| 2,756,145 | 7/1956 | Ballard et al. | 430/607 |
| 2,948,614 | 8/1960 | Allen et al. | 430/446 |
| 3,043,696 | 7/1962 | Herz et al. | 430/603 |
| 3,057,725 | 10/1962 | Herz et al. | 430/611 |
| 3,062,654 | 11/1962 | Allen et al. | 430/603 |
| 3,128,186 | 4/1964 | Corben et al. | 430/611 |
| 3,397,986 | 8/1968 | Millikan et al. | 430/603 |
| 3,563,754 | 2/1971 | Jones et al. | 430/570 |
| 4,006,025 | 2/1977 | Swank et al. | 430/567 |
| 4,468,454 | 8/1984 | Brown | 430/569 |
| 4,474,872 | 10/1984 | Onishi et al. | 430/551 |
| 4,607,000 | 8/1986 | Gunther et al. | 430/428 |
| 4,816,290 | 3/1989 | Heki et al. | 427/430.1 |
| 4,927,744 | 5/1990 | Henzel et al. | 430/566 |
| 4,948,718 | 8/1990 | Factor et al. | 430/522 |

FOREIGN PATENT DOCUMENTS 1570362 7/1980 United Kingdom .

*Primary Examiner*—Charles L. Bowers, Jr.
*Assistant Examiner*—Mark F. Huff
*Attorney, Agent, or Firm*—Sarah Meeks Roberts

[57] ABSTRACT

This invention provides a method of preparing a silver halide photographic emulsion which comprises adding to the silver halide emulsion a solid particle dispersion of a non-labile chalcogen compound represented by Formula I:

$$R^1—X^1—X^2—R^2 \qquad \text{(Formula I)}$$

It further provides a silver halide photographic emulsion prepared by the above method.

21 Claims, No Drawings

AQUEOUS, SOLID PARTICLE DISPERSIONS OF DICHALCOGENIDES FOR PHOTOGRAPHIC EMULSIONS AND COATINGS

BACKGROUND OF THE INVENTION

This patent relates to the use of dichalcogenide compounds in silver halide photographic emulsions and coatings.

Problems with fogging having plagued the photographic industry from its inception. Fog is a deposit of silver or dye that is not directly related to the image-forming exposure, i.e., when a developer acts upon an emulsion layer, some reduced silver is formed in areas that have not been exposed to light. Fog can be defined as a developed density that not associated with the action of the image-forming exposure, and is usually expressed as "Dmin", the density obtained in the unexposed portions of the emulsion. A density, as normally measured, includes both that produced by fog and that produced by exposure to light. It is known in the art that the appearance of photographic fog related to reduction of silver ion can occur during many stages of preparation of the photographic element including silver halide emulsion preparation, (spectral) chemical sensitization of the silver halide emulsion, melting and holding of the liquid silver halide emulsion melts, subsequent coating of silver halide emulsions, and prolonged natural and artificial aging of coated silver halide emulsions.

Several methods have been employed to minimize this appearance of fog. Mercury containing compounds, such as those described in U.S. Pat. Nos. 2,728,663; 2,728,664; and 2,728,665, have been used as additives to combat fog. Thiosulfonate and thiosulfonate esters, such as those described in U.S. Pat. Nos. 2,440,206; 2,934,198; 3,047,393; and 4,960,689, have also been employed. Additionally aromatic, heterocyclic, and acyclic disulfides which do not have labile sulfur or sulfide, such as those described in U.S. Pat. Nos. 1,962,133; 2,465,149; 2,756,145; 3,043,696; 3,057,725; 3,062,654; 3,128,186; and 3,563,754, have been used, primarily as emulsion melt additives.

For the production of photographic photosensitive materials it is well known that many organic additives, especially aromatic dichalcogenides, are substantially insoluble in water. For that reason, the method usually employed for adding such additives to a silver halide photographic emulsion includes first dissolving the organic compound (hereinafter called solute) in an organic solvent freely miscible with water, for example, acetone, methanol, ethanol, propanol, or methyl cellosolve, and adding the solution to an emulsion.

However, these methods have many drawbacks. The use of an organic solvent freely miscible with water can reduce the surface activity of a co-present coating aid, coagulate a co-present binder, or solidify a co-present coupler, thereby markedly hindering high-speed coating. Additionally, because the dichalcogenide solute is substantially insoluble in water, rapid crystallization and/or flocculation of the solute can occur upon addition of the organic solution to the substantially aqueous emulsion melt resulting in solid defects in the photosensitive coatings. Lastly, organic solvents are dangerous to work with because of their volatility, and they have a negative impact on the Earth's ecology.

Aqueous solid particle dispersions of organic additives avoid these drawbacks and have been used in the industry. U.S. Pat. No. 4,006,025 (Swank) describes a dispersion process for sensitizing dyes employing elevated temperature (40°-50° C.) milling of an aqueous dye slurry containing surfactant. British Patent No. 1,570,362 (Langer et al) describes a dispersion process for photographic additives employing milling of an aqueous slurry of the additive in the presence of a surface active agent whose surface tension at 1 g/l is not less than 38 dyne/cm. These patents do not describe the use of these techniques with dichalcogenide compounds.

U.S. Pat. No. 3,397,986 (Herz and Millikan) describes the stabilization of photographic emulsions with bis(p-acylamidophenyl) disulfides. It teaches the introduction of these additives into a photographic emulsion via solutions of the additive in water miscible solvents such as ethanol or acetone or via dispersions commonly employed for photographic couplers. The latter method is taken to mean the process wherein the coupler is dissolved in a water-immiscible solvent; this oil phase is added to an aqueous phase of gelatin, surfactant and water; and the mixture is emulsified using a colloid mill or homogenizer.

There is a continuing need for more effective means of controlling fog in photographic elements. There is also a need for methods of preparing photographic elements which do not require the use of organic solvents.

According to this invention it has been found that if certain dichalcogenide compounds are introduced into a silver halide emulsion or photographic material as solid particle aqueous dispersions, their antifogging effect is significantly larger than that provided by water-miscible, organic solvent solutions or conventional coupler dispersions of the same dichalcogenides. In addition, the antifogging effectiveness of the dichalcogenides may be controlled by the size of the dichalcogenide particle in the solid particle aqueous dispersion. Further this method has a high degree of reproducibility compared to that achieved with water-miscible, organic solvent solutions.

SUMMARY OF THE INVENTION

This invention provides a method of making a photographic silver halide emulsion comprising precipitating and sensitizing a silver halide emulsion and adding to the silver halide emulsion an antifogging amount of a non-labile chalcogen compound represented by Formula I:

$$R^1—X^1—X^2—R^2 \qquad \text{(Formula I)}$$

where $X^1$ and $X^2$ are independently S, Se, or Te; and $R^1$ and $R^2$, together with $X^1$ and $X^2$, form a ring system, or are independently substituted or unsubstituted cyclic, acyclic or heterocyclic groups wherein the dichalcogenide compound is added to the emulsion as a solid particle dispersion.

In one embodiment the dichalcogenide compound is a disulfide compound represented by Formula II or III.

(Formula II)

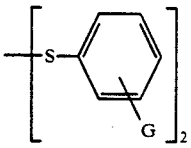

(Formula II)

In formula II, G is independently in an ortho, meta, or para position on the aromatic nucleus relative to the sulfur and is hydrogen, hydroxy, $SO_3M$ or $NR^3R^4$;

M is hydrogen, or an alkaline earth, alkylammonium or arylammonium cation;

$R^3$ is hydrogen or a substituted or unsubstituted alkyl or aryl group;

$R^4$ is hydrogen, O=C—$R^5$, or O=C—N—$R^6R^7$; and $R^5$, $R^6$, and $R^7$ are independently hydrogen, or hydroxy, or an unsubstituted alkyl, or aryl group, or a substituted or unsubstituted fluroralkyl, fluoroaryl, carboxyalkyl, carboxyaryl, alkylthioether, arylthioether, sulfoalkyl, or sulfoaryl group or the free acid, alkaline earth salt or alkylammonium or arylammonium salt of the aforementioned groups.

(Formula III)

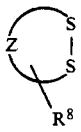

In formula III, Z contains substituted or unsubstituted carbon or hetero atoms sufficient to form a ring; and $R^8$ is a substituted or unsubstituted alkyl or aryl group of 2 to 10 carbon atoms, or the free acid, alkaline earth salt, arylammonium or alkylammonium salt of the aforementioned groups.

In another embodiment the solid particle dispersion is a solid particle gelatin dispersion. In a further embodiment the silver halide emulsion is a silver bromoiodide emulsion. This invention further provides a photographic silver halide emulsion prepared by the methods described above.

DETAILED DESCRIPTION OF THE INVENTION

The dichalcogenic compounds of this invention are represented by Formula I.

$R^1—X^1—X^2—R^2$ (Formula I)

In the above formula $X^1$ and $X^2$ are independently S, Se, or Te; and $R^1$ and $R^2$,together with $X^1$ and $X^2$, form a ring system, or are independently substituted or unsubstituted cyclic, acyclic or heterocyclic groups. Preferably the molecule is symmetrical and $R^1$ and $R^2$ are alkyl or aryl groups. Preferred is the combination resulting in a dichalcogenide with a molecular weight greater that 210 g/mol. $R^1$ and $R^2$ may not be group which cause the compound to become labile, such as, for example,

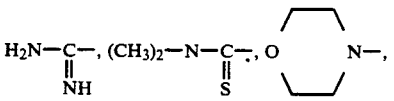

-continued

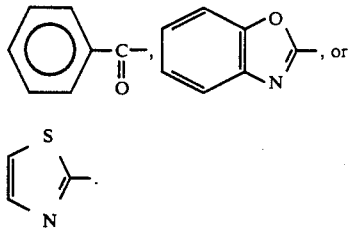

Some of preferred compounds are shown below.

Examples of Formula I $R^1—X^1—X^2—R^2$

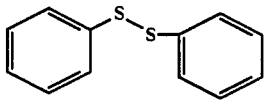

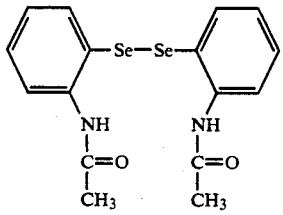

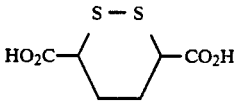

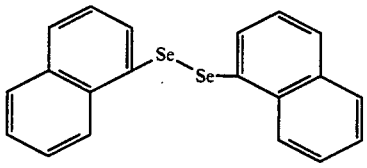

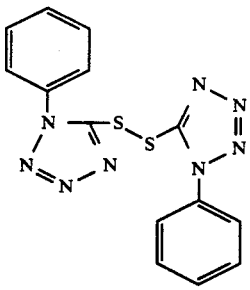

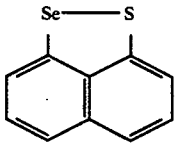

$HO_2C(CH_2)_4—Se—Se—(CH_2)_4CO_2H$

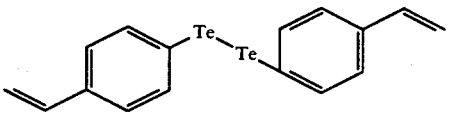

-continued

Examples of Formula I

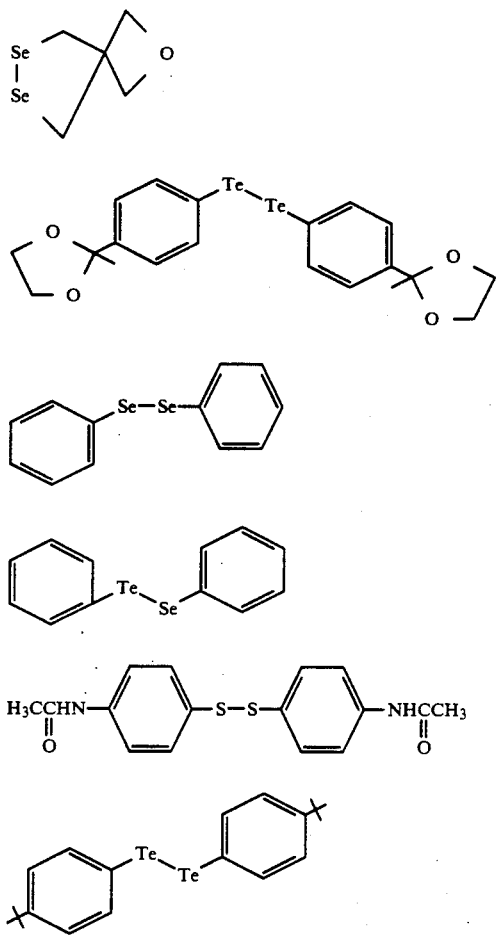

The dichalcogen must be non-labile meaning it does not release elemental chalcogen or chalcogen anion under specified conditions for making conventional photographic emulsions or the resulting photographic elements.

Preferably the dichalcogenide compound is a disulfide compound represented by Formula II or III.

(Formula II)

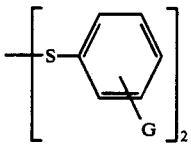

In formula II, G is independently in an ortho, meta, or para position on the aromatic nucleus relative to the sulfur. More preferably the molecule is symmetrical and most preferably G is in the para position. G is hydrogen, hydroxy, $SO_3M$ or $NR^3R^4$. More preferably G is $NR^3R^4$.

M is hydrogen, or an alkaline earth, alkylammonium or arylammonium cation. Preferably M is hydrogen or sodium, and more preferably M is sodium. $R^3$ is hydrogen or a substituted or unsubstituted alkyl or aryl group. Preferred substituents are amino, carboxy methyl, or combinations thereof. The preferred groups contain up to 20 and more preferably up to 10 carbon atoms. Examples of suitable groups are trifluoromethyl, methyl, ethyl, propyl, phenyl, and tolyl.

$R^4$ is hydrogen, O=C—$R^5$, or O=C—N—$R^6R^7$. More preferably $R^4$ is hydrogen or O=C—$R^5$.

$R^5$, $R^6$, and $R^7$ are independently hydrogen, or hydroxy, or an unsubstituted alkyl, or aryl group, or a substituted or unsubstituted fluoroalkyl, fluoroaryl, carboxyalkyl, carboxyaryl, alkylthioether, arylthioether, sulfoalkyl, or sulfoaryl group or the free acid, alkaline earth salt or alkyl ammonium or arylammonium salt of the aforementioned groups. Examples of suitable groups are trifluoromethyl, methyl, ethyl, n-butyl, isobutyl, phenyl naphthyl, carboxymethyl, carboxypropyl, carboxyphenyl, oxalate, terephthalate, methylthiomethyl, and methylthioethyl.

In a more preferred embodiment $R^3$ is a hydrogen or methyl and $R^4$ is O=C—$R^5$. $R^5$ is preferably an alkyl group of 1 to 10 carbon atoms, an aryl group of 6 to 10 carbon atoms or a trifluoromethyl group. Most preferably the disulfide compound is p-acetamidophenyl disulfide.

Examples of preferred disulfide compounds are listed in Table 1.

TABLE I

Examples of Formula II*
Position and substituent structure of G

| | | |
|---|---|---|
| II-1 | para | N(H)C(O)$CH_3$ |
| II-2 | meta | N(H)C(O)$CH_3$ |
| II-3 | ortho | N(H)C(O)$CH_3$ |
| II-4 | para | NH2 × HCl |
| II-5 | para | N(H)C(O)H |
| II-6 | ortho | N(H)C(O)H |
| II-7 | para | N(H)C(O)$CF_3$ |
| II-8 | ortho | N(H)C(O)$CF_3$ |
| II-9 | para | N(H)C(O)-phenyl |
| II-10 | para | N(H)C(O)-ethyl |
| II-11 | para | N(H)C(O)-propyl |
| II-12 | para | N(H)C(O)-naphthyl |
| II-13 | para | N(H)C(O)$C_7H_{15}$ |
| II-14 | para | N(H)C(O)$C_{14}H_{29}$ |
| II-15 | para | N(H)C(O)$C_{17}H_{35}$ |
| II-16 | para | N(H)C(O)$CH_2$—S—$C_{12}H_{25}$ |
| II-17 | para | N(H)C(O)$CH_2$—S—$CH_3$ |
| II-18 | para | N(H)C(O)$C_2H_4$—S—$CH_3$ |
| II-19 | para | N(H)C(O)$CH_2(CH_3)$—S—$CH_3$ |
| II-20 | para | N(H)C(O)-phenyl(2-$SO_3Na$) |
| II-21 | para | N(H)C(O)C$(CH_3)_3$ |
| II-22 | para | N(H)C(O)-phenyl(4-$CO_2CH_3$) |

*atoms in parentheses in structure indicate they are substituted to the atom on the left.

(Formula III)

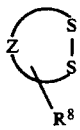

In formula III, Z contains substituted or unsubstituted carbon or hetero atoms sufficient to form a ring. The preferred heteroatom is N. Most preferably Z contains all carbon atoms. Preferred substituents are, for example, methyl, ethyl or phenyl groups. $R^8$ is a substituted or unsubstituted alkyl or aryl group of 2 to 10 carbon atoms, and more preferably 4 to 8 carbon atoms, or the free acid, alkaline earth salt, or the alkylammonium or arylammonium salt of the aforementioned groups. Preferably $R^8$ is a substituted or unsubstituted carboxyalkyl, carboxyaryl, alkyl ester, or aryl ester group. Examples of appropriate substituents include alkyl and aryl groups.

More preferably Z comprises four carbon atoms and $R^8$ is an alkyl or carboxyalkyl group of 4 to 8 carbon atoms, or the free acid, alkaline earth salt or ammonium salt of the aforementioned groups. The most preferred disulfide compound of general formula III is 5-thioctic acid. Examples of Formula III are the following:

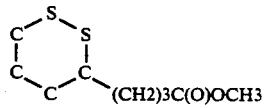

(III-1)

and

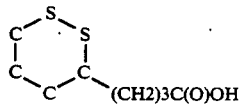

(III-2)

The dichalcogenide compounds of this invention can be prepared by the various methods known to those skilled in the art.

The optimal amount of the dichalcogenide compound to be added will depend on the desired final result, the type of emulsion, the degree of ripening, the chemical structure, and other variables. In general the concentration of dichalcogenide which is adequate is from about $1\times10^{-9}$ to about $1\times10^{-2}$ mol/mol Ag, with $1\times10^{-7}$ to $1\times10^{-2}$ mol/mol Ag being preferred and about $1\times10^{-5}$ to $3\times10^{-4}$ mol/mol Ag being most preferred.

The dichalcogenide compounds are added to the silver halide emulsion as a solid particle dispersion. Unexpectedly, it had been found that addition of the dichalcogenides using this method results in much greater antifogging activity than if the same amount of the dichalcogenide compound is added as taught in the prior art.

The photographic emulsions are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are chemically and spectrally sensitized, as known in the art. Chemical sensitization of the emulsion employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum and diethylsenide; and polymeric agents, e.g., polyalkylene oxides. A temperature rise is employed to complete chemical sensitization (heat spike). Spectral sensitization is effected with agents such as sensitizing dyes. For color emulsions, dyes are added in the spectral sensitization step using any of a multitude of agents described in the art. It is known to add such dyes both before and after the heat spike.

After spectral sensitization, the emulsion is coated on a support. Various coating techniques include dip coating, air knife coating, curtain coating and extrusion coating.

The dichalcogenide solid particle dispersion may be added to the silver halide at any time during the preparation of the emulsion i.e. during precipitation, during spectral/chemical sensitization or as a melt additive. The greatest overall antifogging activity with the least reduction in sensitivity is seen if the solid particle dispersion is added after precipitation and before or during spectral/chemical sensitization as described in copending U.S. application Ser. No. 869,679, Silver Halide Photographic Emulsions Sensitized in the Presence of Organic Dichalcogenides, Klaus et. al., filed concurrently herewith.

The aqueous, solid particle dispersions are prepared by milling an aqueous slurry of dichalcogenide and surfactant using techniques such as those described in the Paint Flow and Pigment Dispersion, Second Edition by Temple C. Patton (Wiley-Interscience, New York 1979) hereafter referred to as Patton. The type of milling technique chosen should be capable of producing an end product in which the dichalcogenide particles are less than 1.0 micron in diameter.

Two examples of suitable milling techniques use the ball mill or a SWECO Vibro-Energy Mill (SWECO, Inc., Los Angeles CA). For both of these methods the solid dichalcogenide compound is placed in the milling vessel with an aqueous phase, a surfactant and a milling media. The aqueous phase may be distilled or tap water. The aqueous phase may also contain additional surfactants or polymers. The concentration of the dichalcogenide compound to the aqueous phase should be from 1% to about 20% for best results.

The surfactant must be one which is compatible with silver halide photographic elements. A preferred surfactant is a purified version of an alkylated aryl polyether sulfonate, such as Triton ® X-200 (Rohm & Haas, Philadelphia, Pa.), but other anionic surfactants are useful. Contrary to the teaching of British Patent 1,570,362, surfactants with a wide range of surface tensions have been found to be suitable. The surfactant/dichalcogenide weight ratio should be about 0.01 to 1, with 0.05 to 0.2 being the most useful.

A variety of milling media can be employed. They can be constructed of glass, ceramics, metals or metal alloys, with ceramics such as zirconium oxide being preferred. The shape and size of the media can be varied but 1-2 mm beads are preferred. The weight of the slurry relative to milling media can be varied, but for the preferred media cited above a ratio of about 0.18 for the SWECO mill and about 0.12 for the ball mill is generally used. In best practice, the vessel is charged with media until half-full and the slurry is then added until the media are just covered. More slurry can be used but milling times to achieve the same particle size will be lengthened.

The above four components may be added to the milling vessel in any order and in any combination. For example the dichalcogenide compound may be mixed with the surfactant to form a slurry and then added to the aqueous phase and the milling media; alternatively all of the components may be added to the vessel simultaneously.

The milling temperature can be varied but is most easily kept at room temperature or slightly higher (<30° C.). Generally the mixture is milled for 1 to 8 days. The desired particle size is the factor which determines milling time. When using a ball mill, milling times are generally from four to eight days. The optimum rotational speed for the ball mill may be calculated from the formula given by Patton.

Following milling, the slurry is separated from the milling media by coarse filtration. The slurry is then diluted to working strength with an aqueous hydrophilic polymer (preferably gelatin) solution, thus forming a solid particle gel dispersion. Alternatively the contents of the vessel, slurry and beads can be diluted into hydrophilic polymer (preferably gelatin) solution and the beads then separated by coarse filtration. Finally, the slurry may be used without dilution or the addition of polymer. Sonification may be used, if necessary, to break up aggregates.

Characterization of the final dispersion for dichalcogenide content may be by spectrophotometric analysis and for particle size by microscopy. Particle size should be less than 1.0 microns. As particle size becomes smaller greater activity is observed.

The following method may be used to determine fog levels in photographic elements. To obtain a positive or reversal image from negative-working silver halide, initial development is effected with a non-chromogenic developing agent to develop exposed silver halide but not form dye. The element is then uniformly fogged with light or, preferably, chemically; this renders the remaining, previously unexposed, silver halide developable. Secondary development is then commenced with a color developer to obtain a positive dye image. This process is known as the E-6 color reversal process and is described in British Journal of Photography Annual, 1982, pp. 201 to 203.

To obtain a negative dye image from the E-6 process, the remaining unexposed silver halide following non-chromogenic development is dissolved out of the element. The developed silver remaining in the element is converted back to silver halide (rehalogenation). Color development and the remaining steps in the E-6 process are completed to give a negative dye image. This rehalogenation version of the E-6 process, is call the E-6 Rehalo process.

The photographic elements of this invention can be non-chromogenic silver image forming elements. They can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like.

In the following discussion of suitable materials for use in the emulsions and elements of this invention, reference will be made to *Research Disclosure,* December 1989, Item 308119, published by Kenneth Mason Publications, Ltd., Dudley Annex, 12*a North Street, Emsworth, Hampshire* P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of the invention can include various couplers including but not limited to those described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof can contain among other things brighteners (Examples in Research Disclosure Section V), antifoggants and stabilizers (Examples in Research Disclosure Section VI), antistain agents and image dye stabilizers (Examples in Research Disclosure Section VII, paragraphs I and J), light absorbing and scattering materials (Examples in Research Disclosure Section VIII), hardeners (Examples in Research Disclosure Section X), plasticizers and lubricants (Examples in Research Disclosure Section XII), antistatic agents (Examples in Research Disclosure Section XIII), matting agents (Examples in Research Disclosure Section XVI) and development modifiers (Examples in Research Disclosure Section XXI).

The photographic elements can be coated on a variety of supports including but not limited to those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The following examples are intended to illustrate, without limiting, this invention.

EXAMPLES

Preparative Example 1

Into a 60- ml brown bottle was placed 1.0 g of compound II-1, 21.68 g of distilled water, 2.65 g of a 6.8% solution of the surfactant Triton® X-200 (Rohm and Haas, Philadelphia, Pa.) containing 34 ml/l 2N propionic acid, and 137 g of 1.8 mm diameter zirconium oxide milling media. The bottle was then capped and mounted on the SWECO mill for four days at room temperature. The bottle and contents were removed from the mill, warmed to 45° C., and 8.0 g of molten deionized, bone gelatin (12.5%) was added with good stirring. The milling media were separated from the dispersion by passing the bottle contents through a coarse mesh sieve. The particles of disulfide in this dispersion were smaller than 1.0 μm by microscopy. A relative but quantitative measure of particle size can be obtained by measuring the absorbance of the sample due to its turbidity. A dispersion such as the one in this example when diluted to 0.15% disulfide and 3.0 % gelatin and measured at 500 nm in a 0.10 mm cell gives an absorbance of 0.20.

Preparative Example 2

Into a 950 cc brown bottle was placed 1600 g of 1.8 mm zirconium oxide milling media. A slurry of disulfide and the surfactant of Example 1 and water was then added. The disulfide concentration of the slurry varied from 5.0 to 10.0 weight percent of the slurry and the surfactant concentration varied from 0.10 to 0.20 weight percent of the disulfide. The bottles of media and slurry were then placed on a ball mill for 4 to 8 days at the optimum rotational speed calculated from the formula of Patton. Following milling, the media were separated from the slurry using a coarse mesh screen and the dispersion diluted with a solution of deionized bone gelatin and water to achieve a concentration of 1.5% and 6.0% gelatin. Microscopy showed all the dispersions to have disulfide particle sizes of less than one micron. Absorbance of these dispersions, measured as described in Example 1 was from 0.14 to 0.25.

Preparative Example 3

SWECO-milled dispersions of disulfides of structures II-3, II-5, II-6, II-7, II-8 were prepared using the method of Example 1.

Preparative Example 4

Ball-mill dispersions using the technique and disulfide described in Example 2 were prepared using various surfactants. The slurries were 7.5% in disulfide, 1.125% surfactant (surfactant-to-disulfide ratio of 0.15), and were milled for 6 days. The surfactants used were Aerosol OT (American Cyanamide, Wayne, NJ), Triton® X-200 (Rohm and Haas, Philadelphia, PA), sodium dodecyl sulfate, oleyl methyl taurine, and sodium dodecylbenzene sulfonate with surface tensions at 1 g/L of 31.1, 28.0, 49.1, 42.4 and 31.9 dyne/cm, respectively. All dispersions had disulfide particle sizes of less than 1 μm.

Preparative Example 5

Into a 1.6 gallon Abbethane jar (Paul O. Abbe Inc., Little Falls, NJ) was placed 10.4 kg of 1.8 mm zirconium oxide milling media, 92.65 g of the disulfide of Example 1, 204.8 g of the surfactant solution of Example 1, and 937.7 g of distilled water. The jar with contents was placed on the ball mill and rotated at 63 rpm as prescribed by Patton for a period of 14 days. Following milling the slurry was separated from the media and diluted with deionized bone gelatin and water as described in Example 2. The particles in the final dispersion were smaller that 1 μm. The absorbance of this dispersion, measured as described in Example 1, was 0.18.

Preparative Example 6

The control emulsion for the following examples was prepared, coated and developed as described below. A 0.56×0.083 μm AgBr/I tabular emulsion (4.1% iodide) was sensitized in the presence of sodium thiocyanate (0.185 g/Ag mole), sodium aurous dithiosulfate dihydrate (6.6 mg/Ag mole), sodium thiosulfate pentahydrate (6.2 mg/Ag mole) DYE-1 (0.88 g/Ag mole) and DYE-2 (0.088 g/Ag mole) by holding at 61° C. for 15 minutes. The resulting sensitized emulsion was mixed with additional water, gelatin, and 4-hydroxy-6-methyl-tetraazaindene sodium salt monohydrate (1.75 g/Ag mole) in preparation for coating. A secondary melt composed of gelatin, COUPLER-1, and coating surfactants was mixed in equal volume with the emulsion melt immediately before coating on a cellulose acetate support. This emulsion layer was then protected by a gelatin overcoat and hardened. The resulting dried coatings were exposed for 0.02 seconds through a stepped density tablet and 0.3 density Inconel and Kodak Wratten 23A filters with 5500 K light. Exposed strips were then developed in rehalogenated E-6 chemistry.

DYE-1

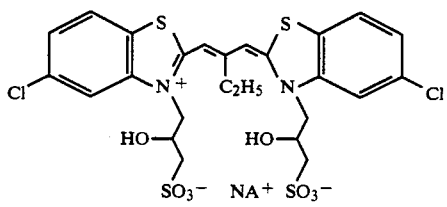

DYE-2

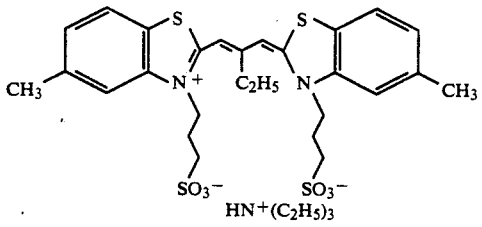

COUPLER-1

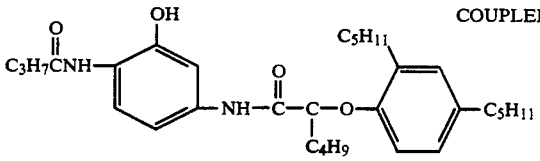

Example 7

A methanolic solution, II-1-M, containing 4.06 g compound II-1/liter was obtained. Portions of this solution were added separately to portions of the raw emulsion of Example 6, prior to addition of other sensitizers. The emulsion was then sensitized, coated and processed as described in Example 6. The D-min and Speed in CR units at 0.3 above D-min were read.

| II-1 level (mg/Ag mole) | D-min | Speed |
|---|---|---|
| none (control) average | 0.605 | 210 |
| 0.3 | 0.514 | 210 |
| 3.0 | 0.451 | 210 |
| 33.0 | 0.049 | 169 |

These results show that not only does the use of compound II-1 diminish the fresh fog and speed when used in this fashion, but also the activity is dependent on level used.

Example 8

Portions of the dispersion of Example 1, II-1-D, were added to the raw emulsion of Example 6 prior to addition of other sensitizers to give 33 mg II-1/ Ag mole as in Example 7. A blank gelatin solution without II-1, designated, O-D, was prepared and an equivalent weight compared to II-1-D was added to another portion of raw emulsion and treated as above. II-1-M was also added to portions of raw emulsion to give 33 mg II-1 / Ag mole. The emulsions were then sensitized, coated and processed as in Example 6. The following results were observed.

| Additive | D-min | Speed |
|---|---|---|
| none (control) average | 0.505 | 211 |
| O-D | 0.465 | 213 |
| II-1-M | 0.030 | 171 |
| II-1-D | 0.022 | 138 |

It is seen that whether in the form of a methanol solution or a solid particle dispersion, the effect of the disulfide is seen as a fog restrainer when used in this fashion. The additional decrease in D-min and Speed from II-1-D, not explained solely to the effect of O-D, is surprising and indicates greater activity from the solid particle dispersion of II-1.

Example 9

A conventional dispersion was prepared by heating a slurry of the 10.0 g of disulfide II-1 in 140.0 g of cyclohexanone until the disulfide dissolves. This organic solvent solution was poured into 850 g of an aqueous solution of 8.0% bone gelatin and 0.8% sodium triisopropylnaphthalenesulfonate with good mixing and then passed through a colloid mill five times. The resulting dispersion was rapidly chill set, noodled and washed for 14 hours in hardened water to remove the cyclohexanone. This dispersion is designated II-1-CS.

Example 10

Portions of the conventional dispersion II-1-CS were added to the raw emulsion of Example 6 prior to addition of other sensitizers to give 5 mg II-1 / Ag mol, as in Example 7. Separate emulsion portions were treated likewise with II-1-D at 5 mg II-1 / Ag mol. Still further portions of emulsion were treated likewise with II-1-M to give 5 mg II-1 / Ag mol. After sensitizing coating and processing the emulsions as in Example 6, the following results were obtained.

| Additive | D-min |
|---|---|
| None (control) average | 0.410 |
| II-1-M average | 0.249 |
| II-1-CS average | 0.244 |
| II-1-D average | 0.141 |

The results show that both the methanolic solution and the conventional dispersion of p-acetamidophenyl disulfide diminish D-min. However, the solid particle dispersion is much more active as a D-min reducer than the conventional dispersion. This greater activity was not anticipated from teachings in the prior art.

Example 11

Four solid particle dispersion samples of II-1 were prepared which varied in particle size. The relative particle sizes were monitored by the absorbance technique of Example 1.

Portions of emulsion prepared as described in Example 6 were treated separately with the different particle size dispersions to give 5 mg II-1 / Ag mol. The emulsions were then exposed and processed as in Example 6.

| Dispersion | D-min | Absorbance @ 500 mm |
|---|---|---|
| control (no dispersion) | 0.410 | — |
| II-1-D-1 | 0.068 | 0.14 |
| II-1-D-2 | 0.129 | 0.20 |
| II-1-D-3 | 0.174 | 0.20 |
| II-1-D-4 | 0.207 | 0.22 |

These results show that as the particle size of the solid particle dispersion gets smaller the D-min reduction increases.

Example 12

Various amounts of the solution II-1-M from Example 7 were added to a 5% solution of bone gelatin. When the methanol solution made up more than 0.5% of the total solution volume, crystals of the disulfide larger than 10 μm were detected by microscopy. Equally important, when the methanol solution was 1.0% and 2.0%, repeat experiments failed to generate the same size or size distribution of crystals. It is believed that this same crystallization is occurring when the methanol solution is added to emulsions and photographic coating melts and that subsequent filtration prior to the coating event would lead to variable levels of the disulfide in the photographic element and variable photographic results. In contrast, when gelatin solutions containing similar levels of disulfide are prepared using aqueous solid particle dispersions such as those of Example 1 and 2, no evidence of large crystals are seen via microscopy. Therefore less variable, more reproducible photographic results should result when using elements prepared using the aqueous solid particle dispersion.

While the invention has been described in detail and with reference to specific embodiments thereof, it will be apparent to one skilled in the art that various changes and modifications can be made therein without departing from the spirit and scope thereof.

What is claimed is:

1. A method of making a photographic silver halide emulsion comprising precipitating and sensitizing a silver halide emulsion and further comprising adding to the silver halide emulsion an antifogging amount of a non-labile chalcogen compound represented by Formula I:

$$R^1—X^1—X^2—R^2 \qquad \text{(Formula I)}$$

where $X^1$ and $X^2$ are independently S, Se, or Te; and $R^1$ and $R^2$, together with $X^1$ and $X^2$, form a ring system, or are independently substituted or unsubstituted cyclic, acyclic or heterocyclic groups; and wherein the dichalcogenic compound is added as a solid particle dispersion.

2. The method of claim 1 wherein $R^1$ and $R^2$ are independently substituted alkyl or aryl groups; the dichalcogenide molecule is symmetrical and the molecular weight is greater than 210 g/mol.

3. The method of claim 1 wherein the dichalcogenide compound is a disulfide compound represented by Formula II or III:

(Formula II)

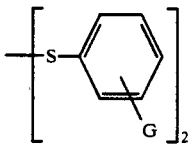

where

G is independently in an ortho, meta, or para position on the aromatic nucleus relative to the sulfur and is hydrogen, hydroxy, $SO_3M$ or $NR^3R^4$;

M is hydrogen, or an alkaline earth, alkylammonium or arylammonium cation;

$R^3$ is hydrogen, or a substituted or unsubstituted alkyl or aryl group;

$R^4$ is hydrogen, O=C—$R^5$, or O=C—N—$R^6R^7$; and $R^5$, $R^6$, and $R^7$ are independently hydrogen, or hydroxy, or an unsubstituted alkyl, or aryl group, or a substituted or unsubstituted fluoroalkyl, fluoroaryl, carboxyalkyl, carboxyaryl, alkylthioether, arylthioether, sulfoalkyl, or sulfoaryl group or the free acid, alkaline earth salt or alkylammonium or arylammonium salt of the aforementioned groups;

(Formula III)

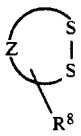

where Z contains substituted or unsubstituted carbon or hetero atoms sufficient to form a ring; and $R^8$ is a substituted or unsubstituted alkyl or aryl group of 2 to 10 carbon atoms, or the free acid, alkaline earth salt, arylammonium or alkylammonium salt of the aforementioned groups.

4. The method of claim 3 wherein the disulfide is represented by Formula II and the molecule is symmetrical; and where G is in an ortho, meta, or para position on the aromatic nucleus relative to the sulfur and is $NR^3R^4$; and $R^4$ is hydrogen, or O=C—$R^5$.

5. The method of claim 4 wherein G is in a para position relative to sulfur, $R^3$ is hydrogen or methyl, $R^4$ is O=C—$R^5$ and $R^5$ is an alkyl group of 1 to 10 carbon atoms, an aryl group of 6 to 10 carbon atoms or a trifluoromethyl group.

6. The method of claim 5 wherein the disulfide compound is bis (4-acetamidophenyl) disulfide.

7. The method of claim 3 wherein the disulfide compound is represented by Formula III and $R^8$ is a substituted or unsubstituted carboxyalkyl, carboxyaryl, alkyl ester, or aryl ester group of 2 to 10 carbon atoms, or the free acid, alkaline earth salt, arylammonium or alkylammonium salt of the aforementioned groups.

8. The method of claim 7 wherein Z comprises carbon atoms sufficient to form a ring and $R^8$ is a substituted or unsubstituted alkyl or aryl group of 4 to 8 carbon atoms, or the free acid, alkaline earth salt, arylammonium or alkylammonium salt of the aforementioned groups.

9. The method of claim 8 wherein $R^8$ is a substituted or unsubstituted carboxyalkyl, carboxyaryl, alkyl ester, or aryl ester group of 4 to 8 carbon atoms, or the free acid, alkaline earth salt, arylammonium or alkylammonium salt of the aforementioned groups.

10. The method of claim 9 wherein the disulfide compound is 5-thioctic acid.

11. The method of claim 3 wherein the antifogging amount of the disulfide compound is $1\times10^{-7}$ to $1\times10^{-2}$ mol/mol Ag.

12. The method of claim 3 wherein the antifogging amount of the disulfide compound is $1\times10^{-5}$ to $3\times10^{-4}$ mol/mol Ag.

13. The method of claim 3 wherein the solid particle size is less than 1 micron.

14. The method of claim 3 wherein the solid particle dispersion is a solid particle gelatin dispersion prepared by mixing the disulfide compound with a surfactant, an aqueous phase and a milling media to form a slurry; milling the slurry; filtering out the milling media; and mixing the remaining slurry with gelatin.

15. The method of claim 14 wherein the surfactant is an alkylated aryl polyether sulfonate.

16. The method of claim 3 wherein the silver halide emulsion is a silver bromoiodide emulsion.

17. A method of making a photographic silver halide emulsion comprising precipitating and sensitizing a silver bromoiodide emulsion and further comprising adding to the silver bromoidide emulsion $1\times10^{-7}$ to $1\times10^{-2}$ mol/mol Ag of a disulfide compound represented by formula II;

(Formula II)

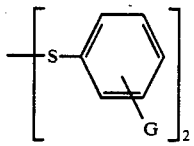

wherein G is in a para position relative to sulfur and is NR3R4, $R^3$ is hydrogen or methyl, $R^4$ is O=C—$R^5$ and $R^5$ is an alkyl group of 1 to 10 carbon atoms, an aryl group of 6 to 10 carbon atoms or a trifluoromethyl group; and wherein the disulfide compound is added as a solid particle gel dispersion.

18. The method of claim 17 wherein the antifogging amount of the disulfide compound is $1\times10^{-5}$ to $3\times10^{-4}$ mol/mol Ag.

19. The method of claim 17 wherein the solid particle size is less than 1 micron.

20. The method of claim 17 wherein the solid particle gel dispersion was prepared using an alkylated aryl polyether sulfonate as a surfactant.

21. A photographic silver halide emulsion prepared by the method described in any one of claims 1 through 20.

* * * * *